US007612756B2

(12) United States Patent
Kim

(10) Patent No.: US 7,612,756 B2
(45) Date of Patent: Nov. 3, 2009

(54) APPARATUS AND METHOD OF DRIVING LIGHT SOURCE FOR IMAGE DISPLAY DEVICE AND IMAGE DISPLAY DEVICE HAVING THE SAME

(75) Inventor: Min-Hong Kim, Seoul (KR)

(73) Assignee: Samsung Electronics Co., Ltd. (KR)

( * ) Notice: Subject to any disclaimer, the term of this patent is extended or adjusted under 35 U.S.C. 154(b) by 653 days.

(21) Appl. No.: 10/963,077

(22) Filed: Oct. 12, 2004

(65) Prior Publication Data

US 2005/0110732 A1 May 26, 2005

(30) Foreign Application Priority Data

Nov. 21, 2003 (KR) ..... 10-2003-0082981

(51) Int. Cl.
*G09G 3/36* (2006.01)

(52) U.S. Cl. ..... 345/102; 345/87; 345/89; 345/100

(58) Field of Classification Search ..... 345/55–102, 345/204–214, 690–697
See application file for complete search history.

(56) References Cited

U.S. PATENT DOCUMENTS 4,958,915 A 9/1990 Okada et al.
6,812,915 B2 * 11/2004 Yamaguchi ..... 345/99
2002/0050973 A1 5/2002 Takaoka et al. ..... 345/100
2003/0038770 A1 * 2/2003 Lee et al. ..... 345/102
2003/0214478 A1 * 11/2003 Yoo et al. ..... 345/102

FOREIGN PATENT DOCUMENTS

| | | |
|---|---|---|
| CN | 1296255 | 5/2001 |
| JP | 9-5705 | 10/1997 |
| KR | 20000060041 | 10/2000 |

* cited by examiner

*Primary Examiner*—David L Lewis
(74) *Attorney, Agent, or Firm*—Cantor Colburn LLP

(57) ABSTRACT

An image display device includes a display panel having gate and data lines electrically connected with pixels, gate and data drivers providing a gate signal and a data voltage, respectively, to corresponding ones of the pixels, and an inverter providing a lamp driving signal to drive a lamp unit. The lamp driving signal includes a wave signal of which rising and falling slope intervals are substantially equal to each other during a gate-on voltage interval in which the data voltage is charged in corresponding one of the pixels. The image display device also includes a signal controller for generating a gate control signal to control timing of generation of the gate-on voltage and a synchronization signal having a 90° phase difference with respect to the gate control signal. The synchronization signal is provided to the inverter.

17 Claims, 7 Drawing Sheets

APPARATUS AND METHOD OF DRIVING LIGHT SOURCE FOR IMAGE DISPLAY DEVICE AND IMAGE DISPLAY DEVICE HAVING THE SAME

BACKGROUND OF THE INVENTION

1. Field of the Invention

The present invention relates to a system for displaying images, and more particularly to, a device and a method of driving a light source for image display devices and an image display device having the same.

2. Description of the Related Art

Image display devices, such as computer monitors, television sets, etc., generally include self-emitting display devices and non- emitting display devices. The self-emitting display devices are ones that actively emit light themselves to display images, such as light emitting diode (LED) display devices, electroluminescence (EL) display devices, vacuum fluorescent display (VFD) devices, field emission display (FED) devices, and plasma panel display (PDP) devices. In contrast, the non-emitting display devices are ones that use light externally provided from a light source, such as liquid crystal display (LCD) devices.

The LCD devices generally include two panels having electric field generating electrodes and a liquid crystal layer having dielectric anisotropy, which is interposed between the two panels. In an LCD device, the electric field generating electrodes receive electric voltages and generate electric field across the liquid crystal layer. Light transmittance of the liquid crystal layer varies depending on the strength of the electric field applied thereto, and the electric field is controlled by the voltages applied to the electric field generating electrodes. Desired images are displayed by adjusting the applied voltages.

The LCD devices employ either natural light or light generated from a light source, such as lamps, that is equipped in the LCD devices. When an LCD device employs lamps as the light source, the brightness on a screen of the LCD device is usually adjusted by regulating the ratio of on and off durations of the lamps or regulating the current flowing in the lamps.

The lamps for the LCD devices usually include fluorescent lamps. The fluorescent lamps generally require a high AC voltage having a magnitude typically in the range of several kilovolts and a frequency typically in the range of dozens of kilohertz. The current flowing in such fluorescent lamps has a magnitude of several milli-amperes.

Since the lamps in an LCD device are closely disposed at the rear side of an LCD panel at a distance of several millimeters, electric and/or magnetic fields generated from the lamps make noise to signals in wires and thin film transistors (TFTs) of the LCD panel. In particular, since the frequency of a driving signal for the lamps and the frequency of a horizontal synchronization signal for the LCD panel are similar but slightly different from each other, a beating occurs to cause interference that makes horizontal stripes, called "waterfall," on a screen of the LCD device.

SUMMARY OF THE INVENTION

The above mentioned and other drawbacks and deficiencies of the prior art are overcome or alleviated by a device and a method of driving a light source for image display devices and an image display device having the same according to the present invention. In one embodiment, an apparatus for driving a light source in an image display device includes a signal controller that generates a synchronization signal in response to input control signals externally provided, and an inverter that generates a driving signal synchronized with the synchronization signal, the driving signal being provided to the light source, in which a gate signal of a gate line includes a gate-on voltage and a gate-off voltage to control activation of pixels in the image display device, and the driving signal includes a wave signal of which a rising slope interval and a falling slope interval are substantially equal to each other during a gate-on voltage interval in which a data voltage of a data line in the image display device is charged in corresponding one of the pixels. The signal controller may also generate a gate control signal to control timing of generation of the gate-on voltage, and the synchronization signal has a phase difference of 90° with respect to the gate control signal.

In another embodiment, the apparatus for driving a light source further includes a phase shifter that receives the gate control signal from the signal controller and generates the synchronization signal to the inverter. The synchronization signal has a phase difference of 90° with respect to the gate control signal.

In another embodiment, the apparatus for driving a light source further includes a multi-vibrator that receives a data enable signal from the signal controller and generates the synchronization signal to the inverter. The date enable signal controls timing of image data provided to a data driver of the image display device, and the synchronization signal has a phase difference of 90° with respect to the gate control signal.

In another embodiment, an image display device includes a display panel having gate lines and data lines electrically connected with pixels of the image display device, a gate driver that provides a gate signal to corresponding ones of the pixels via the gate lines, a data driver that provides a data voltage to corresponding ones of the pixels via the data lines, a lamp unit that provides light to the display panel, and an inverter that provides a lamp driving signal to drive the lamp unit, in which the lamp driving signal includes a wave signal of which a rising slope interval and a falling slope interval are substantially equal to each other during a gate-on voltage interval in which the data voltage is charged in corresponding one of the pixels. A signal controller is also included to generate a gate control signal to control timing of generation of the gate-on voltage, and a synchronization signal having a phase difference of 90° with respect to the gate control signal. The lamp driving signal is synchronized with the synchronization signal. The wave signal of the lamp driving signal may be a sinusoidal signal.

In another embodiment, a method for driving a light source for providing light to a display panel in an image display device, includes providing a gate signal to control activation of corresponding pixels in the display panel, the gate signal including a gate-on voltage and a gate-off voltage, providing a data voltage to activated pixels to display images, generating a gate control signal to control timing of generation of the gate-on voltage, phase-shifting the gate control signal to generate a synchronization signal, and generating a driving signal to drive the light source, in which the driving signal is synchronized with the synchronization signal and has a sinusoidal wave that is substantially symmetric with respect to a vertical center line within a gate-on voltage interval during which the data voltage is charged in corresponding one of the pixels.

BRIEF DESCRIPTION OF THE DRAWINGS

This disclosure will present in detail the following description of exemplary embodiments with reference to the following figures wherein.

DETAILED DESCRIPTION OF THE INVENTION

Figure 1:
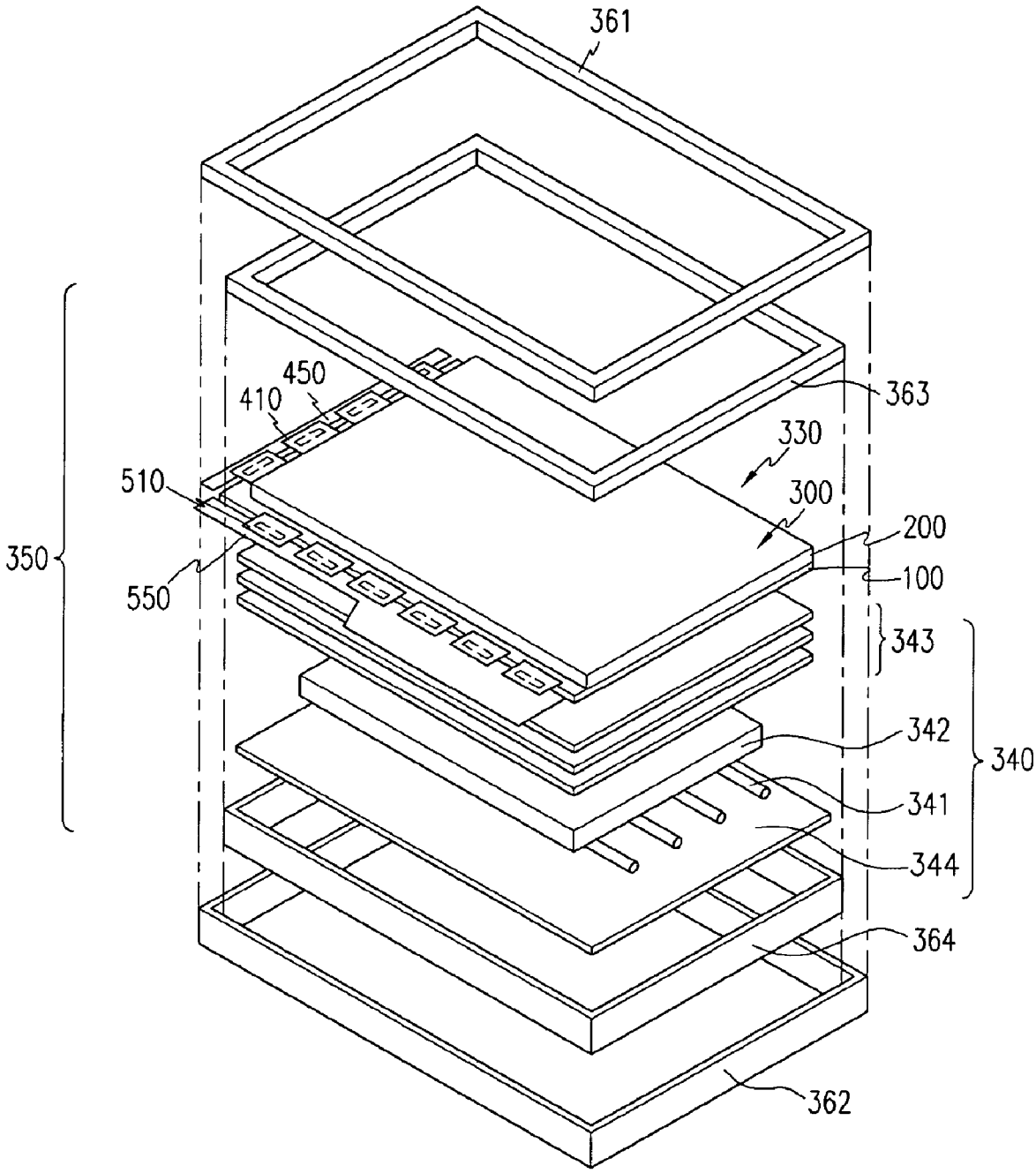
FIG. 1 is an exploded perspective view of an LCD device according to an exemplary embodiment of the present invention.

Detailed illustrative embodiments of the present invention are disclosed herein. However, specific structural and functional details disclosed herein are merely representative for purposes of describing exemplary embodiments of the present invention. In the drawings, the thickness and/or length of layers and regions may be exaggerated for clarity.

Figure 2:
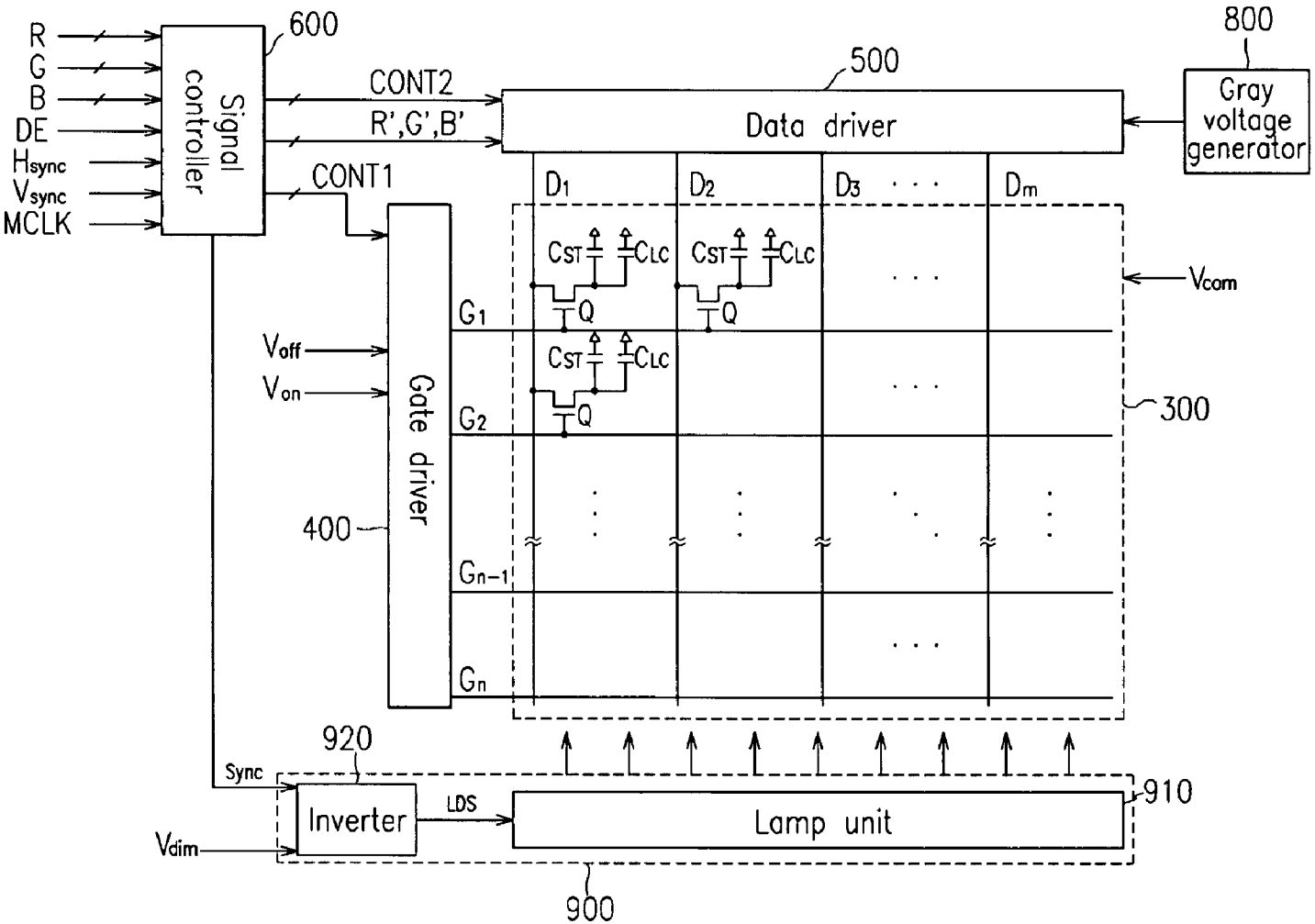
FIG. 2 is a block diagram of the parts of the LCD device in FIG. 1.
Figure 3:
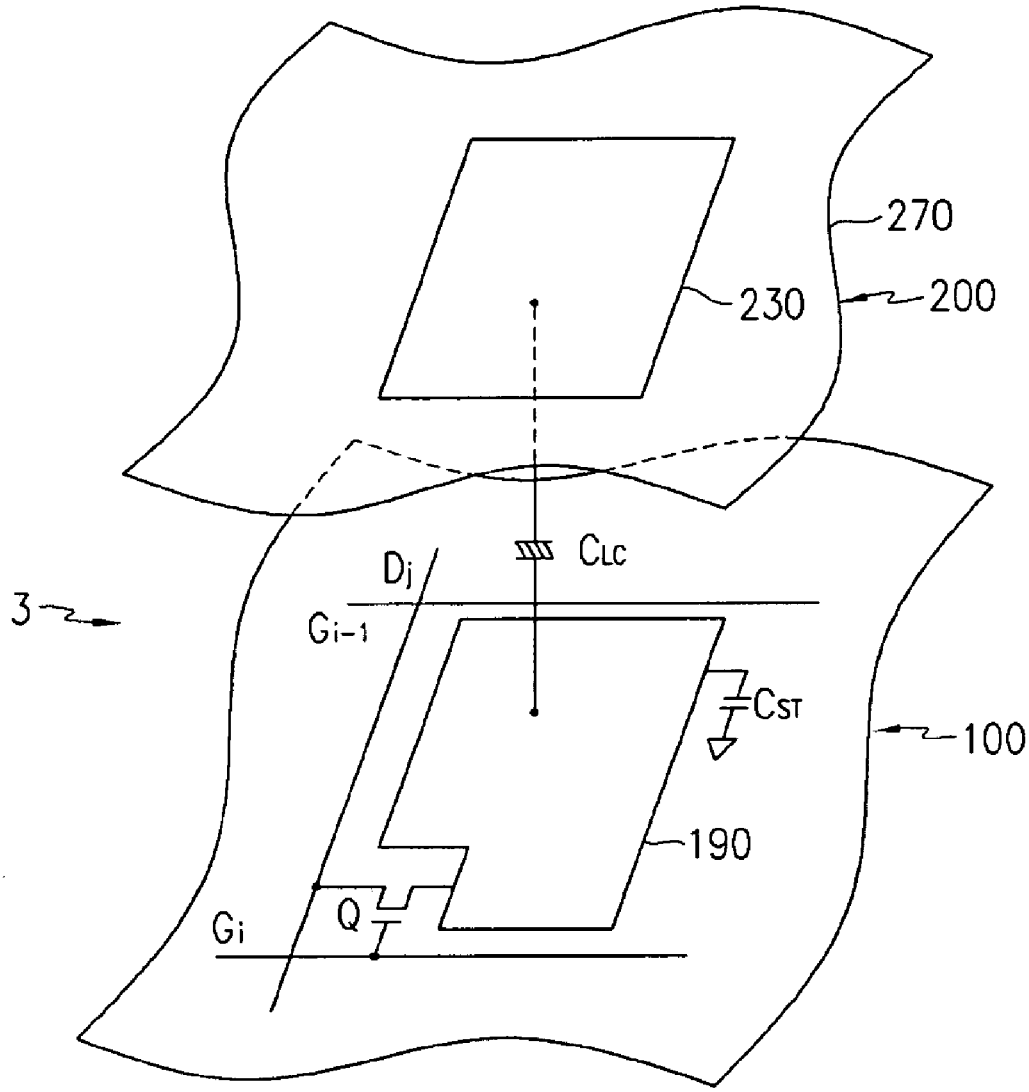
FIG. 3 is an equivalent circuit diagram of a pixel of the LCD device in FIG. 2.

A liquid crystal display (LCD) device according to an embodiment of the present invention is described below with reference to FIGS. 1 to 3. FIG. 1 is an exploded perspective view of an LCD device according to an exemplary embodiment of the present invention, FIG. 2 is a block diagram of certain parts of the LCD device in FIG. 1, and FIG. 3 is an equivalent circuit diagram of a pixel of the LCD device in FIGS. 1 and 2.

Referring to FIG. 1, the LCD device includes a liquid crystal (LC) module 350, front and rear cases 361 and 362, a chassis 363 and a mold frame 364 that receive and stably contain the LC module 350. The LC module 350 includes a display unit 330 and a backlight unit 340. In the display unit 330, an LCD panel assembly 300 is provided to have a lower panel 100, an upper panel 200 and a liquid crystal layer 3 (referring to FIG. 3) interposed between the lower and upper panels 100 and 200. The display unit 330 includes display signal lines and pixels that are electrically connected with each other and arranged in a matrix form.

The backlight unit 340 includes one or more lamps 341 disposed behind the LC panel assembly 300 and a light guide plate 342 and optical sheets 343 disposed between the panel assembly 300 and the lamps 341. The light guide plate 342 and the optical sheets 343 diffuse the light from the lamps 341 to provide the panel assembly 300 with the light having a uniform luminance distribution. The backlight unit 340 includes a reflector 344 disposed under the lamps 341 to reflect the light from the lamps 341 toward the panel assembly 300.

The lamps 341 include fluorescent lamps such as CCFL (cold cathode fluorescent lamp) and/or EEFL (external electrode fluorescent lamp). Light emitting diodes may be used as the lamps 341.

The display unit 330 includes the LC panel assembly 300, gate tape carrier packages (TCPs) or chip-on-film (COF) type packages 410 and data TCPs 510 attached to the LCD panel assembly 300, and a gate printed circuit board (PCB) 450 and a data PCB 550 which are electrically connected with the gate TCPs 410 and the data TCPs 510, respectively.

A pair of polarizers (not shown) polarizing the light from the lamps 341 are attached on the outer surfaces of the lower and upper panels 100 and 200 of the panel assembly 300.

Referring to FIG. 2, the LCD panel assembly 300 is electrically connected with a gate driver 400 and a data driver 500 via gate lines G1-Gn and data lines D1-Dm, respectively. A gray voltage generator 800 is electrically connected with the data driver 500. A lighting unit 900 illuminating the LCD panel assembly 300 has a lamp unit 910 and an inverter 920. A signal controller 600 provides control signals to the gate and data drivers 400 and 500, the inverter 920 and other elements.

Referring to FIGS. 2 and 3, the display signal lines G1-Gn and D1-Dm are disposed on the lower panel 100. The gate lines G1-Gn transfer gate signals (or scanning signals) and the data lines D1-Dm transfer data signals. The gate lines G1-Gn are disposed substantially parallel with each other in a row direction, and the data lines D1-Dm are disposed substantially parallel with each other in a column direction.

Each pixel includes a switching element Q electrically connected to the display signal lines G1-Gn and D1-Dm and an LC capacitor CLC and a storage capacitor $C_{ST}$ that are electrically connected to the switching element Q. The storage capacitor $C_{ST}$ may be omitted if unnecessary.

The switching element Q, which may be implemented as a thin film transistor (TFT), is disposed on the lower panel 100. The switching element Q has three terminals: a control terminal electrically connected to corresponding one of the gate lines G1-Gn; an input terminal electrically connected to corresponding one of the data lines D1-Dm; and an output terminal electrically connected to the LC capacitor $C_{LC}$ and the storage capacitor $C_{ST}$.

The LC capacitor $C_{LC}$ includes a pixel electrode 190 disposed on the lower panel 100, a common electrode 270 disposed on the upper panel 200, and the LC layer 3 disposed between the pixel and common electrodes 190 and 270 as a dielectric. The pixel electrode 190 is electrically connected with the output terminal of the switching element Q. The common electrode 270 covers the substantially entire surface of the upper panel 100 and is supplied with a common voltage Vcom. In another embodiment, both the pixel and common electrodes may be disposed on the lower panel 100 and have a bar or stripe shape.

The storage capacitor $C_{ST}$ is an auxiliary capacitor for the LC capacitor $C_{LC}$. The storage capacitor $C_{ST}$ includes the pixel electrode 190, a separate signal line (not shown) disposed on the lower panel 100, and an insulator disposed between the pixel electrode 190 and the separate signal line. A predetermined voltage, such as the common voltage Vcom, is supplied to the separate signal line. In another embodiment, the storage capacitor $C_{ST}$ may be formed with the pixel electrode 190, an adjacent gate line (or the previous gate line), and an insulator disposed between the pixel electrode and the adjacent gate line.

For color display, each pixel uniquely represents one of the three primary colors (i.e., spatial division) or each pixel sequentially represents the three primary colors in turn (i.e., temporal division). In spatial or temporal division color display system, spatial or temporal sum of the three primary colors represents a desired color. An example of the spatial division is shown in FIG. 3, in which each pixel includes a color filter 230 representing one of red, green and blue colors. The color filter 230 is disposed on the upper panel 200 facing the pixel electrode 190. In another embodiment, the color filter may be provided on or under the pixel electrode 190 on the lower panel 100.

The lighting unit 900 includes the lamp unit 910 having the lamps 341 shown in FIG. 1 and the inverter 920 electrically connected to the lamp unit 910. The inverter 920 turns on and off the lamp unit 910 and controls the timing of on-time and off-time of the lamp unit 910 to adjust luminance of a screen of the LCD device. The inverter 920 may be disposed on a stand-alone inverter PCB (not shown), or on the gate or data PCB 450 or 550.

In this embodiment, the gray voltage generator 800 is disposed on the data PCB 550 and generates two sets of gray voltages associated with transmittance of the pixels. The gray voltages in one set have a positive polarity with respect to the common voltage Vcom, while those in the other set have a negative polarity with respect to the common voltage Vcom.

The gate driver 400 includes a plurality of integrated circuit (IC) chips mounted on the respective gate TCPs 410. The gate driver 400 is electrically connected to the gate lines G1-Gn of the panel assembly 300 and synthesizes the gate-on voltage Von and the gate off voltage Voff from an external device to generate gate signals for application to the gate lines G1-Gn.

The data driver 500 includes a plurality of IC chips mounted on the respective data TCPs 510. The data driver 500 is electrically connected to the data lines D1-Dm of the panel assembly 300 and applies data voltages selected from the gray voltages supplied from the gray voltage generator 800 to the data lines D1-Dm.

In another embodiment of the present invention, the IC chips of the gate driver 400 or the data driver 500 are mounted on the lower panel 100. In further another embodiment, one or both of the drivers 400 and 500 are incorporated along with other elements into the lower panel 100. The gate PCB 450 and/or the gate TCPs 410 may be omitted in such embodiments.

The signal controller 600 controlling the gate and data drivers 400 and 500 and other components is disposed on the data PCB 550 or the gate PCB 450.

Figure 4:
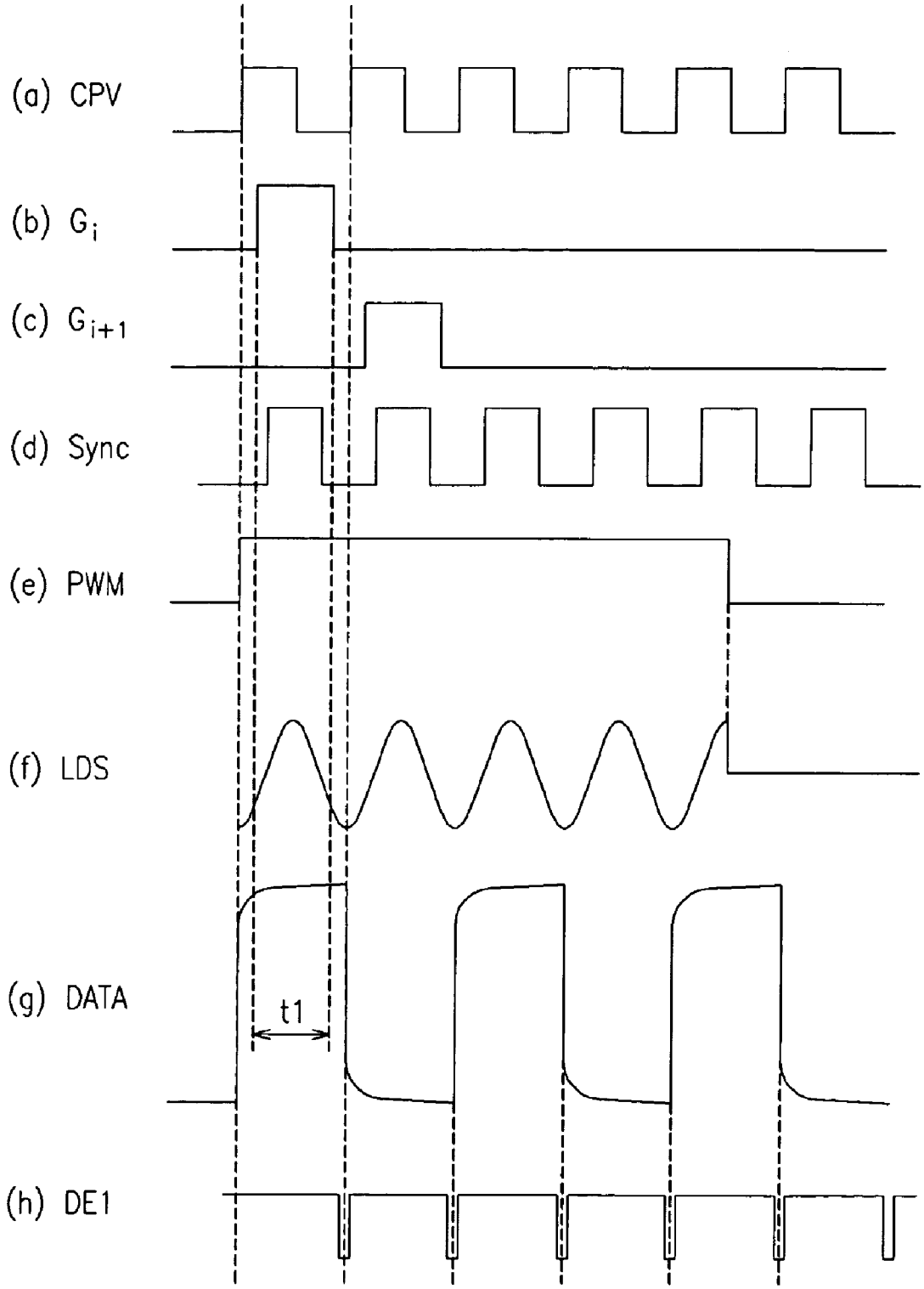
FIG. 4 a graphical view of signal waveforms of the signals used in the LCD device of FIG. 2.

FIG. 4 is a graphical view of signal waveforms of the signals used in the LCD device of FIG. 2. The operation of the LCD device will be described in detail with reference to FIGS. 2 to 4.

The signal controller 600 receives input image signals R, G and B and input control signals, such as a vertical synchronization signal Vsync, a horizontal synchronization signal Hsync, a main clock MCLK, and a data enable signal DE, for controlling the display from an external graphics controller (not shown). The signal controller 600 generates gate control signals CONT1, data control signals CONT2 and processing the image signals R, G and B suitable for the operation of the panel assembly 300 in response to the input control signals and the input image signals R, G and B. The signal controller 600 then provides the gate control signals CONT1 to the gate driver 400 and the processed image signals R', G' and B' and the data control signals CONT2 to the data driver 500. The signal controller 600 also provides an inverter synchronization signal Sync to the inverter 920.

The gate control signals CONT1 include a vertical synchronization start signal for instructing to start outputting the gate-on voltage Von, a gate clock signal CPV for controlling the output time of the gate-on voltage Von, and an output enable signal for defining the duration of the gate-on voltage Von. The data control signals CONT2 include a horizontal synchronization start signal for informing of start of a horizontal period, a load signal for instructing to apply the appropriate data voltages to the data lines D1-Dm, an inversion control signal for reversing the polarity of the data voltages (with respect to the common voltage Vcom) and a data clock signal. The inverter synchronization signal Sync is phase-shifted by about 90° compared with the gate clock signal CPV.

The data driver 500 receives a packet of the image data R', G' and B' for a pixel row from the signal controller 600 and converts the image data R', G' and B' into the analog data voltages selected from the gray voltages supplied from the gray voltage generator 800 in response to the data control signals CONT2 from the signal controller 600. The data driver 500 then outputs the data voltages to the data lines D1-Dm.

Responding to the gate control signals CONT1 from the signal controller 600, the gate driver 400 applies the gate-on voltage Von to selected one(s) of the gate lines G1-Gn so that the switching element(s) Q electrically connected to the corresponding gate line(s) is turned on. The data voltages applied to the data lines D1-Dm are provided to the pixels through the activated switching elements Q.

The difference between the data voltage and the common voltage Vcom applied to a pixel corresponds to a pixel voltage, i.e., a charged voltage of the LC capacitor $C_{LC}$. The liquid crystal molecules have different orientations depending on the magnitude of the pixel voltage.

The inverter 920 controls on/off operations of the lamp unit 910 in response to the inverter synchronization signal Sync supplied from the signal controller 600 and a dimming control signal Vdim supplied from an external device or the signal controller 600. The inverter 920 generates a pulse width modulation signal PWM having a duty ratio of on/off period on the basis of the dimming control signal Vdim. In addition, the inverter 920 generates a sinusoidal voltage signal by turning on/off a DC (direct current) voltage supply from a DC/DC converter (not shown) or by switching current paths. The inverter 920 then boosts up the level of the sinusoidal voltage signal to generate a lamp driving signal LDS. The lamp unit 910 lights on in response to the lamp driving signal LDS provided from the inverter 920, and a current synchronized with the lamp driving signal LDS flows in the lamp unit 910.

As shown in FIG. 4, the lamp driving signal LDS has a sinusoidal wave during a high section of the PWM signal, while the lamp driving signal LDS has a constant value during a low section of the PWM signal. In a different embodiment, however, the lamp driving signal LDS may have a sinusoidal wave and a constant value during low and high sections, respectively, of the PWM signal.

The light from the lamp unit 910 passes through the LC layer 3 and experiences changes in its polarization. The changes of the polarization are converted into changes in the light transmittance by the polarizers.

By repeating this procedure every horizontal period, all gate lines G1-Gn are sequentially supplied with the gate-on voltage Von during a frame, thereby applying the data voltages to all the pixels. One horizontal period is equal to, for example, one period of the horizontal synchronization signal Hsync, the data enable signal DE, or the gate clock signal CPV. When the next frame starts after finishing one frame, the inversion control signal applied to the data driver 500 is controlled such that the polarity of the data voltages is reversed (which is called "frame inversion"). The inversion control signal may also be controlled such that the polarity of the data voltages flowing in a data line in one frame are reversed (which is called "line inversion"), or the polarity of the data voltages in one pixel are reversed (which is called "dot inversion").

Figure 5A:
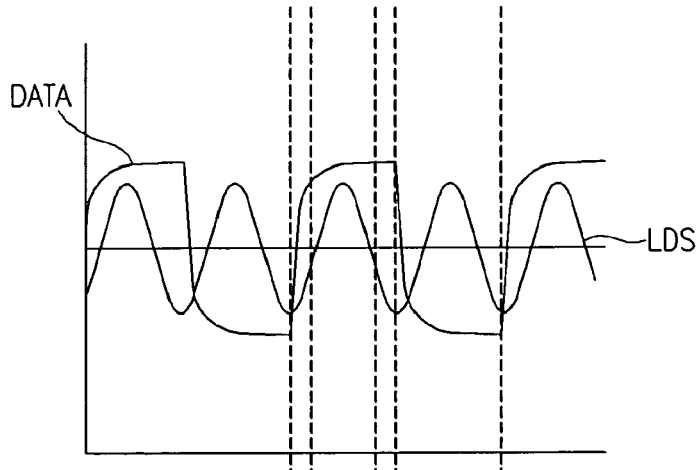
FIGS. 5A-5C show different waveforms of a lamp driving signal used in the LCD device of FIG. 2.
Figure 5B:
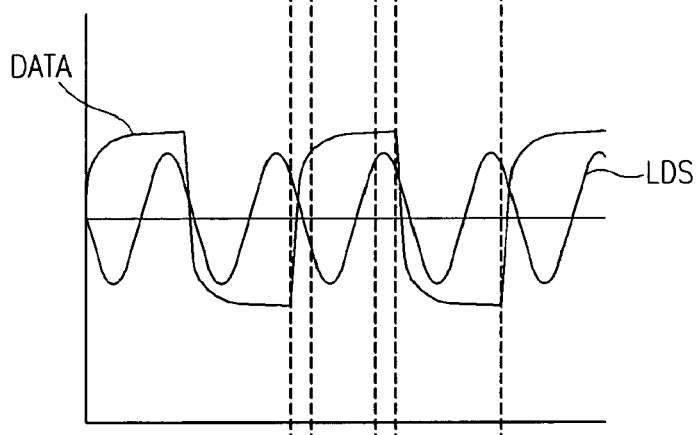
Figure 5C:
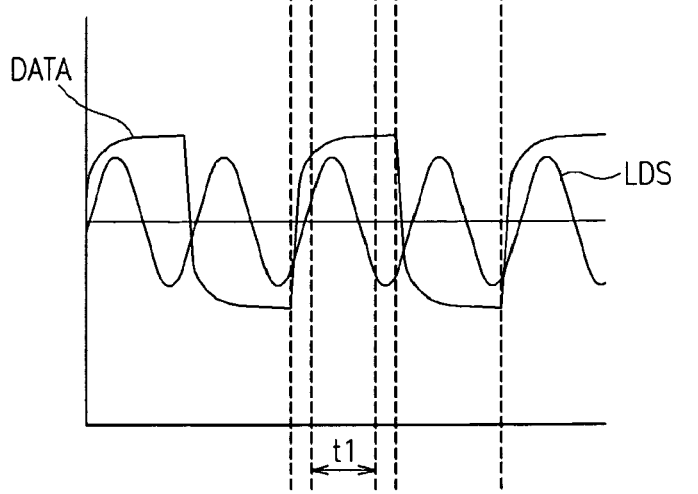

FIGS. 5A and 5B show waveforms of the lamp driving signal LDS having a phase difference of 90° and 180°, respectively, with respect to the gate clock signal CPV, and FIG. 5C shows a waveform of the lamp driving signal LDS synchronized with the gate clock signal CPV. In FIGS. 5A-5C, is also shown a data voltage DATA that is synchronized with the gate clock signal CPV and has a polarity inverting every horizontal period.

According to the experiments, when the lamp driving signal LDS has the phase difference of 180° with respect to the gate clock signal CPV or is synchronized with the gate clock signal CPV as shown in FIGS. 5B and 5C, a phenomenon called "waterfall" in which dapples slowly move up and down on a screen was not occurred. However, suspended horizontal dapples still remained. In contrast, when the lamp driving signal LDS has the phase difference of 90° with respect to the gate clock signal CPV as shown in FIG. 5A, the horizontal dapples did not occur either.

Furthermore, the luminance of the screen was increased when a rising slope interval of the lamp driving signal LDS (i.e., an interval of the signal part having a positive tangent) is larger than a falling slope interval of the lamp driving signal LDS (i.e., an interval of the signal part having a negative tangent) during a gate-on voltage interval t1 in which the data voltage DATA with the positive polarity is charged as shown in FIG. 5B. On the contrary, the luminance of the screen was reduced when the falling slope interval of the lamp driving signal LDS is lager than the rising slope interval of the lamp driving signal LDS during the gate-on voltage interval t1 as shown in FIG. 5C.

However, there was no change in the luminance of the screen when the rising slope interval of the lamp driving signal LDS is substantially equal to the falling slope interval of the lamp driving signal LDS during the gate-on voltage interval t1 when the data voltage DATA with positive or negative polarity is charged as shown in FIG. 5A.

Therefore, it is concluded that the horizontal dapples are removed when the rising slope interval of the lamp driving signal LDS is substantially equal to the falling slope interval of the lamp driving signal LDS during the gate-on voltage interval t1. In other words, no horizontal dapple appears on the screen when the sinusoidal wave of the lamp driving signal LDS is substantially symmetric with respect to a vertical center line within the gate-on voltage interval.

Figure 6:
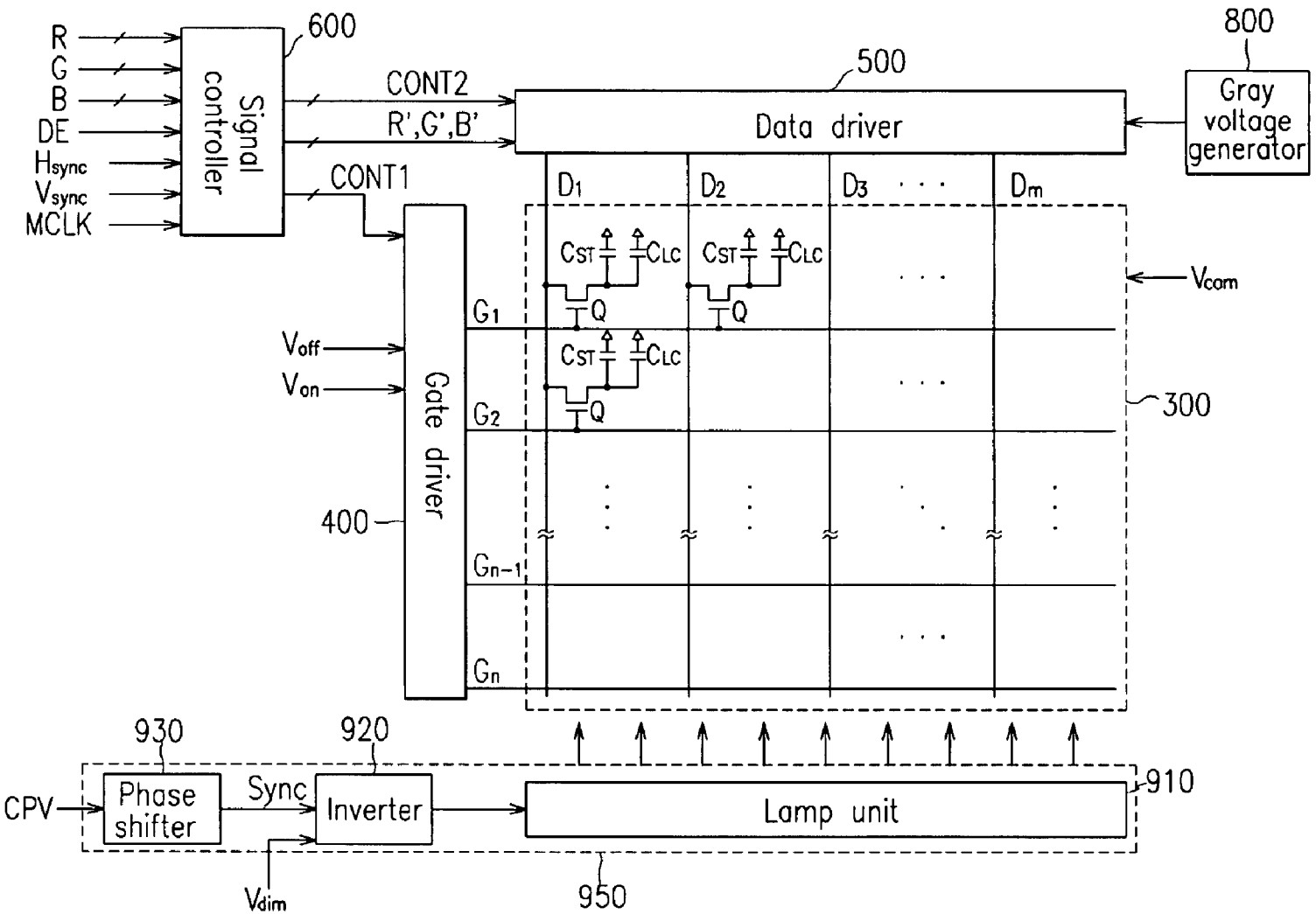
FIG. 6 is a block diagram of an LCD device according to another embodiment of the present invention.
Figure 7:
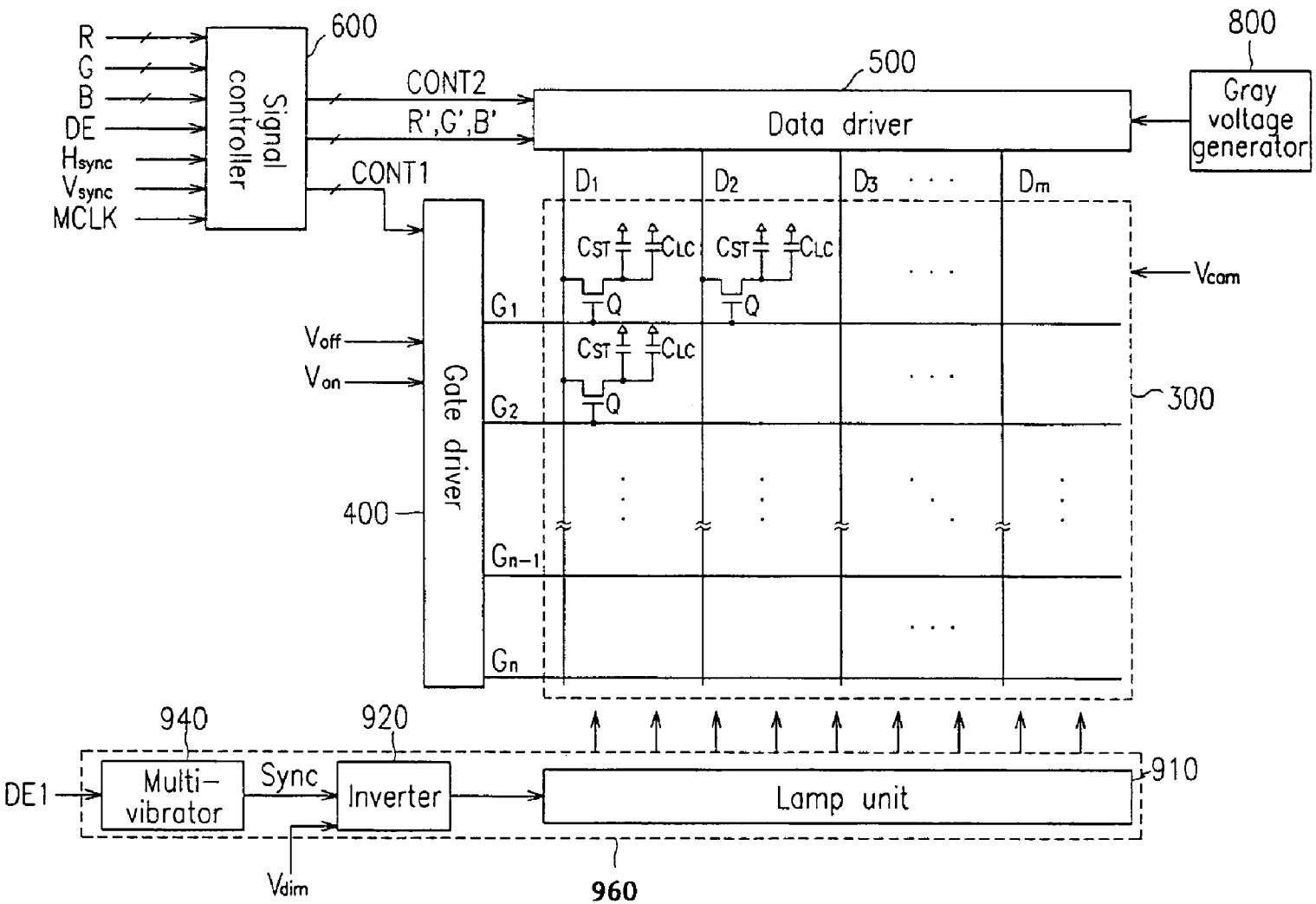
FIG. 7 is a block diagram of an LCD device according to further another embodiment of the present invention.

FIG. 6 is a block diagram of an LCD device according to another embodiment of the present invention, and FIG. 7 is a block diagram of an LCD device according to further another embodiment of the present invention. Like the LCD device in FIG. 1, the LCD devices in FIGS. 6 and 7 each include the LCD panel assembly 300, the gate driver 400, the data driver 500, the signal controller 600, and the gray voltage generator 800.

Unlike the lighting unit 900 of the LCD device in FIG. 2, which includes the lamp unit 910 and the inverter 920, lighting units 950 and 960 of the LCD devices in FIGS. 6 and 7 further include a phase shifter 930 and a multi-vibrator 940, respectively, besides the lamp unit 910 and the inverter 920.

In the LCD device of FIG. 6, the signal controller 600 directly provides the gate clock signal CPV to the phase shifter 930. The phase shifter 900 then generates the synchronization signal Sync in response to the gate clock signal CPV, in which the synchronization signal Sync is phase-delayed by 90° with respect to the gate clock signal CPV.

In the LCD device of FIG. 7, the signal controller 600 (or an external device) provides a data enable signal DE1 to the multi-vibrator 940. The multi-vibrator 940 then generates the synchronization signal Sync in response to the data enable signal DE1, in which the synchronization signal Sync is phase-delayed by 90° with respect to the gate clock signal CPV. In this embodiment, the data enable signal DE1 for controlling the timing of the image signals R', G' and B' is used as a trigger signal of the multi-vibrator 940. Output time and pulse width of the inverter synchronization signal Sync are regulated by adjusting a time constant, i.e., the resistance of resistors or the capacitance of capacitors, of the multi-vibrator 940.

In the LCD devices of FIGS. 6 and 7, the inverter 920 generates the lamp driving signal LDS having the rising and falling slope intervals that are substantially identical. The phase shifter 930 and the multi-vibrator 940 may be incorporated into the inverter 920. It should be noted that instead of the phase shifter 930 and the multi-vibrator 940, another device may be employed to generate the inverter synchronization signal Sync having the 90° phase difference with respect to the gate clock signal CPV.

While the present invention has been described in detail with reference to the exemplary embodiments, it is to be understood that the invention is not limited to the disclosed embodiments, but, is intended to cover various modifications and equivalent arrangements included within the sprit and scope of the appended claims.

What is claimed is:

1. An apparatus for driving a light source in an image display device in which a gate signal of a gate line includes a gate-on voltage and a gate-off voltage to control activation of pixels of the image display device, the apparatus comprising:

a signal controller that generates a synchronization signal in response to input control signals externally provided, wherein the signal controller generates a gate control signal to control timing of generation of the gate-on voltage, and the synchronization signal generated from the signal controller has a phase difference of 90° with respect to the gate control signal; and an inverter that generates a driving signal synchronized with the synchronization signal, the driving signal being provided to the light source, wherein the driving signal includes a wave signal of which a rising slope interval and a falling slope interval are substantially equal to each other during a gate-on voltage interval in which a data voltage of a data line in the image display device is charged in corresponding one of the pixels.

2. The apparatus of claim 1, wherein the gate-on voltage interval is smaller than a period of the gate control signal.

3. An apparatus for driving a light source in an image display device in which a gate signal of a gate line includes a gate-on voltage and a gate-off voltage to control activation of pixels of the image display device, the apparatus comprising:

a signal controller that generates a synchronization signal in response to input control signals externally provided, wherein the signal controller generates a gate control signal to control timing of generation of the gate-on voltage;

an inverter that generates a driving signal synchronized with the synchronization signal, the driving signal being provided to the light source; and, a phase shifter that receives the gate control signal from the signal controller and generates the synchronization signal to the inverter, the synchronization signal having a phase difference of 90° with respect to the gate control signal, wherein the driving signal includes a wave signal of which a rising slope interval and a falling slope interval are substantially equal to each other during a gate-on voltage interval in which a data voltage of a data line the image display device is charged in corresponding one of the pixels.

4. The apparatus of claim 1, further including a multi-vibrator that receives a data enable signal from the signal controller and generates the synchronization signal to the inverter, wherein the data enable signal controls timing of image data provided to a data driver of the image display device.

5. The apparatus of claim 4, wherein the synchronization signal has a phase difference of 90° with respect to the gate control signal.

6. The apparatus of claim 1, wherein the wave signal of the driving signal is substantially symmetric with respect to a vertical center line within the gate-on voltage interval.

7. The apparatus of claim 6, wherein the wave signal of the driving signal is a sinusoidal signal.

8. An image display device comprising:

a display panel having gate lines and data lines electrically connected with pixels of the image display device;

a gate driver that provides a gate signal to corresponding ones of the pixels via the gate lines;

a data driver that provides a data voltage to corresponding ones of the pixels via the data lines;

a lamp unit that provides light to the display panel;

an inverter that provides a lamp driving signal to drive the lamp unit; and a signal controller that generates a gate control signal to control timing of generation of the gate-on voltage, wherein the signal controller generates a synchronization signal to the inverter, the synchronization signal having a phase difference of 90° with respect to the gate control signal, the lamp driving signal being synchronized with the synchronization signal, and wherein the lamp driving signal includes a wave signal of which a rising slope interval and a falling slope interval are substantially equal to each other during a gate-on voltage interval in which the data voltage is charged in corresponding one of the pixels.

9. The image display device of claim 8, wherein the gate-on voltage interval is smaller than a period of the gate control signal.

10. An image display device comprising:

a display panel having gate lines and data lines electrically connected with pixels of the image display device;

a gate driver that provides a gate signal to corresponding ones of the pixels via the gate lines;

a data driver that provides a data voltage to corresponding ones of the pixels via the data lines;

a lamp unit that provides light to the display panel;

an inverter that provides a lamp driving signal to drive the lamp unit;

a signal controller that generates a gate control signal to control timing of generation of the gate-on voltage; and a phase shifter that receives the gate control signal from the signal controller and generates the synchronization signal to the inverter, the synchronization signal having a phase difference of 90° with respect to the gate control signal, wherein the lamp driving signal includes a wave signal of which a rising slope interval and a falling slope interval are substantially equal to each other during a gate-on voltage interval in which the data voltage is charged in corresponding one of the pixels.

11. The image display device of claim 8, wherein the signal controller generates a data enable signal to control timing of image data provided to a data driver of the image display device.

12. The image display device of claim 11, further including a multi-vibrator that receives the data enable signal and generates the synchronization signal to the inverter, the synchronization signal having a phase difference of 90° with respect to the gate control signal.

13. The image display device of claim 8, wherein the wave signal of the lamp driving signal is substantially symmetric with respect to a vertical center line within the gate-on voltage interval.

14. The image display device of claim 13, wherein the wave signal of the lamp driving signal is a sinusoidal signal.

15. A method for driving a light source for providing light to a display panel in an image display device, comprising:

providing a gate signal to control activation of corresponding pixels in the display panel, the gate signal including a gate-on voltage and a gate-off voltage;

providing a data voltage to activated pixels to display images;

generating a gate control signal to control timing of generation of the gate-on voltage;

phase-shifting the gate control signal to generate a synchronization signal; and generating a driving signal to drive the light source, the driving signal being synchronized with the synchronization signal and having a wave signal that is substantially symmetric with respect to a vertical center line within a gate-on voltage interval during which the data voltage is charged in corresponding one of the pixels, wherein the phase-shifting the gate control signal includes shifting a phase of the gate control signal by 90° to generate the synchronization signal.

16. The method of claim 15, wherein the wave signal of the driving signal has a rising slope interval and a falling slope interval that are substantially equal to each other during the gate-on voltage interval.

17. The method of claim 15, wherein the wave signal of the driving signal is a sinusoidal signal.

* * * * *